United States Patent [19]

Burnetter

[11] 4,218,963

[45] Aug. 26, 1980

[54] VENTILATING SYSTEM FOR VOTIVE STANDS

[76] Inventor: Peter W. Burnetter, 78 S. Pine Ave., Albany, N.Y. 12208

[21] Appl. No.: 4,398

[22] Filed: Jan. 18, 1979

[51] Int. Cl.[2] ..... F23J 11/00

[52] U.S. Cl. ..... 98/115 R; 55/385 R; 55/473; 312/33; 431/295

[58] Field of Search ..... 98/115 R, 115 LH; 55/385 R, 473, DIG. 29; 431/295, 289; 126/299 D, 299 F; 312/229, 33, 234, 204

[56] References Cited

U.S. PATENT DOCUMENTS

| | | | |
|---|---|---|---|
| 1,366,370 | 1/1921 | Ellison | 98/115 R X |
| 3,516,232 | 6/1970 | Gilbertson | 98/115 R X |
| 3,942,940 | 3/1976 | O'Shea | 431/295 X |

FOREIGN PATENT DOCUMENTS

| | | | |
|---|---|---|---|
| 1156581 | 5/1958 | France | 126/299 D |
| 491033 | 8/1938 | United Kingdom | 98/115 R |

*Primary Examiner*—Albert J. Makay
*Assistant Examiner*—Harold Joyce
*Attorney, Agent, or Firm*—D. Paul Weaver

[57] ABSTRACT

A concealed ventilating system for votive stands constantly draws decor damaging candle emissions into the interior of the stand and through a filter box contained therein. Substantially clean air is exhausted at the bottom of the stand gently and silently. The system does not detract from the traditional appearance and functioning of votive stands on which it is installed.

2 Claims, 5 Drawing Figures

VENTILATING SYSTEM FOR VOTIVE STANDS

BACKGROUND OF THE INVENTION

Votive stands in churches and shrines generally remain located in the same place for years and their candle emissions which include carbon gradually blacken the adjacent wall surfaces and surrounding decor, necessitating frequent and costly painting and other redecorating if favorable appearance is to be maintained. Insofar as is known, this problem has never been dealt with in the prior art. Some prior U.S. patents of general interest are made of record herein under 37 C.F.R. 1.56, as follows: U.S. Pat. Nos. 563,732; 1,636,994; 2,052,596; 3,199,435; 3,260,189; 3,278,114; 3,425,334; 3,942,940; 3,952,640 and 4,016,809.

The object of the invention is to deal with the problem of decor damaging candle emissions in votive stands by providing thereon an essentially concealed low cost exhaust or ventilating system which continually and gently draws the emissions to the interior of the stand and directs them through a contaminant removing filter, following which essentially clean air is silently discharged toward the floor at the bottom of the stand. The system is compatible with various types of votive stands, is not difficult to install, and does not lessen in any way the traditional appearance and functional features of the stands on which the system is installed.

Other features and advantages of the invention will become apparent during the course of the following description.

DETAILED DESCRIPTION

Figure 1:
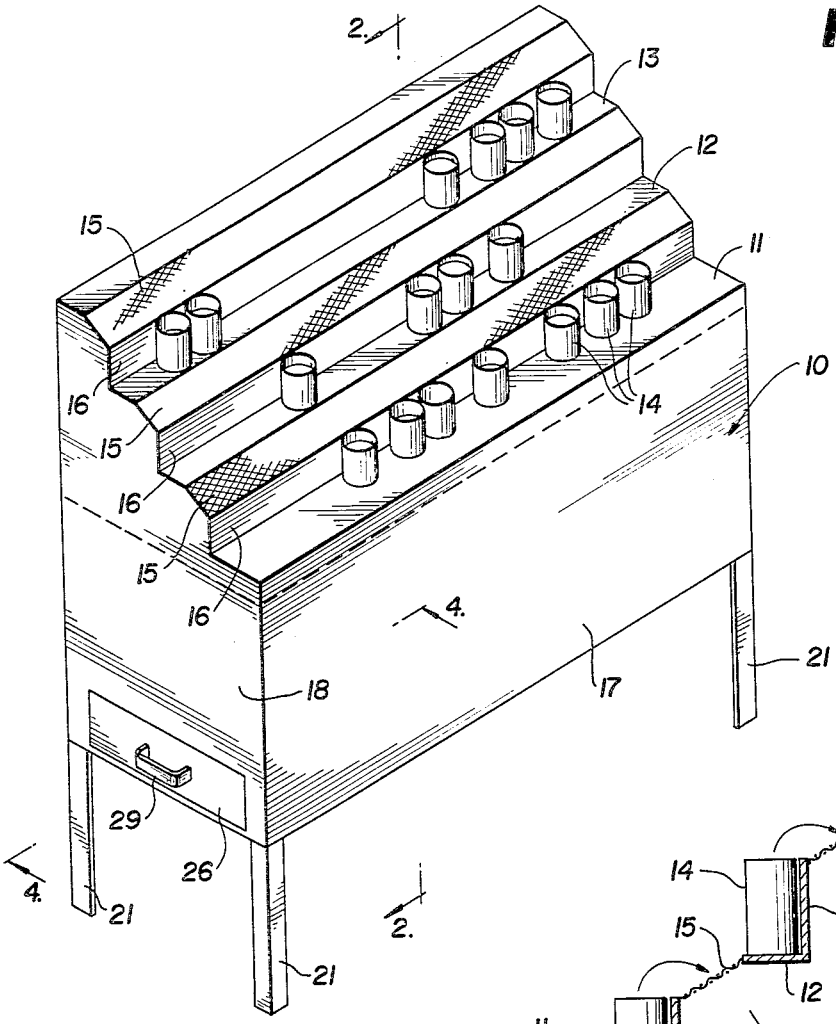
FIG. 1 is a perspective view of a votive stand equipped with the invention according to one embodiment thereof.
Figure 2:
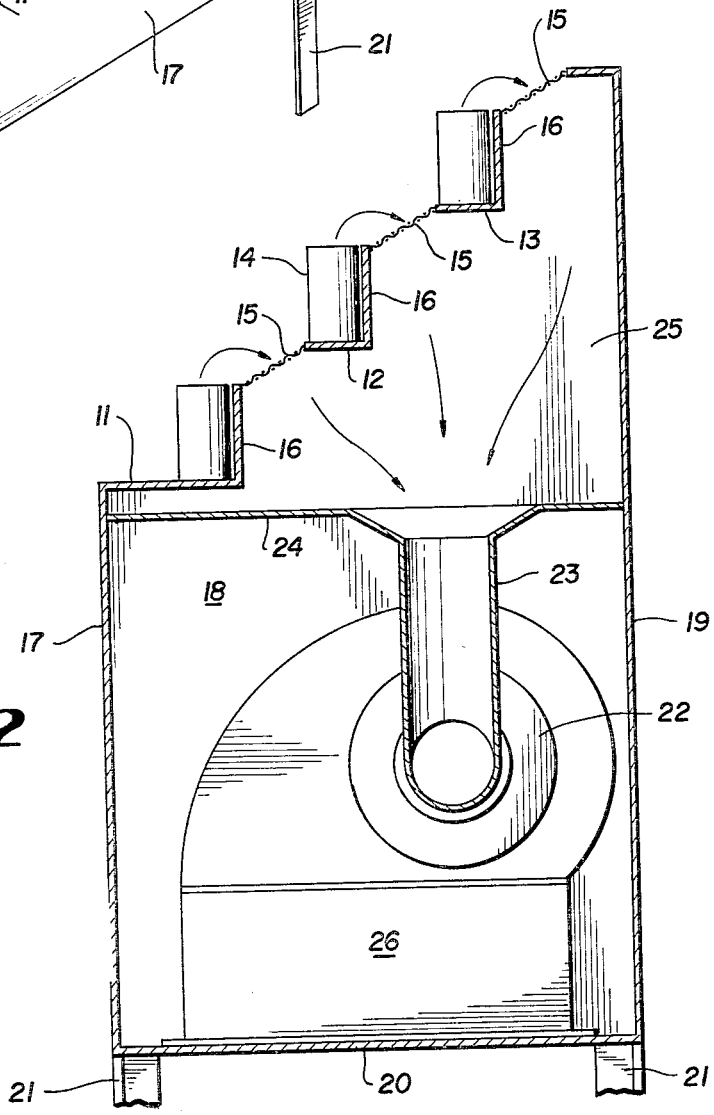
FIG. 2 is an enlarged vertical section through the stand taken on line 2—2 of FIG. 1.

Referring to the drawings in detail, wherein like numerals designate like parts, the numeral 10 designates a votive stand having plural stepped support surfaces 11, 12 and 13 for a multiplicity of conventional votive lights or candles 14. The stepped horizontal support surfaces are intervened by inclined perforated panels 15 formed of screening and connected to the tops of vertical riser panels 16, as shown.

Below the lowermost horizontal support surface 11, the stand 10 is enclosed by a front wall 17, side walls 18, a rear wall 19 and a bottom wall or panel 20. The stand is supported on four suitable height legs 21.

Figure 4:
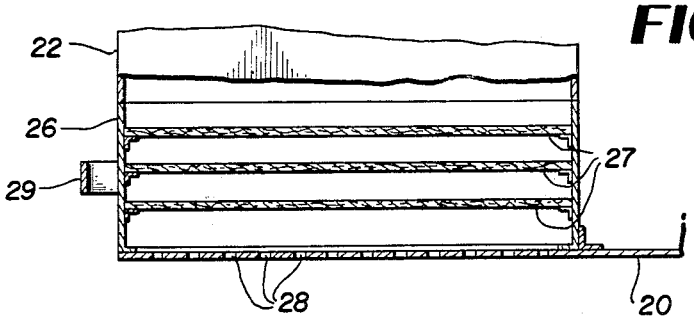
FIG. 4 is a fragmentary vertical section through a filter box taken on line 4—4 of FIG. 1.
Figure 3:
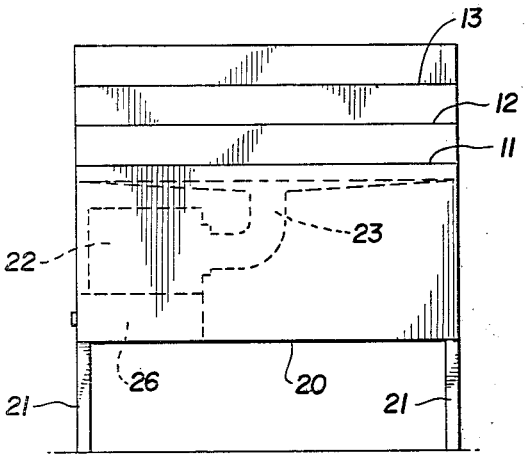
FIG. 3 is a front elevation of the stand on a reduced scale.

The ventilating system comprises a centrifugal blower 22 fixed within the lower enclosed chamber of the stand and having a rising inlet duct 23 connected in a horizontal panel 24 near and below the support surface 11. A plenum chamber 25 is formed in the stand above the panel 24 into which the candle emissions are drawn before entering the blower inlet duct 23. The bottom discharge side of the blower communicates directly with the open top of a sliding filter drawer 26 arranged immediately above the bottom wall 20. The filter drawer 26 preferably contains a plurality of spaced filter elements 27 of the type used in hot air furnaces and the like. Other forms of filter elements may be used, if preferred. At the bottom of the filter drawer 26, which is open, the wall 20 of the stand is apertured at 28, FIG. 4, so that the filtered or clean air may be discharged downwardly toward the floor beneath the votive stand. The filter drawer 26 which slides horizontally is equipped with a convenience handle 29.

During operation, while the candles 14 are burning, their emissions are constantly drawn into the plenum chamber 25 through screen panels 15 by the action of the blower 22. The emissions are forced downwardly from the blower oultlet and through the elements 27 of the filter drawer where contaminants are removed. Essentially clean air is then discharged downwardly through the apertures 28 in a gentle and silent manner.

Figure 5:
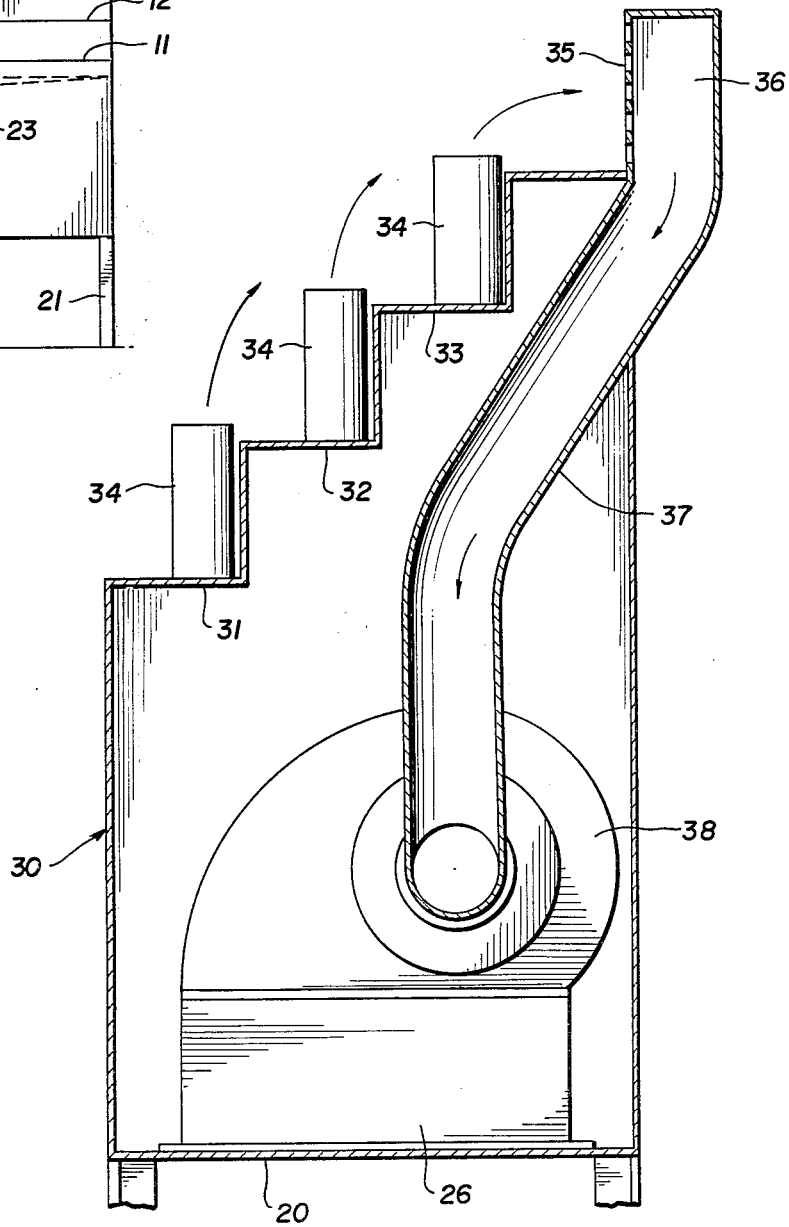
FIG. 5 is a vertical section, similar to FIG. 2, showing a second embodiment of the system on a votive stand.

FIG. 5 shows a second embodiment of the invention in which a votive stand 30 has stepped horizontal support surfaces 31, 32 and 33 for votive lights 34. In this embodiment, the inclined screen panels 15 are not utilized. Instead thereof, an apertured vertical panel 35 spans the top of the stand and forms the front wall of a small plenum chamber 36 communicating directly with the inlet duct 37 of the centrifugal blower 38. As in the prior embodiment, the blower 38 discharges downwardly through the same filter drawer 26 and apertured bottom wall 20. When the blower 38 is active, the emissions from all banks of candles 34 are drawn through the apertured panel 35 and into the chamber 36, and then to the blower 38 and filter drawer or unit. The good results are essentially the same with either embodiment, in that surrounding walls do not become covered with soot and painting is required much less often.

In some cases a different type of air mover than the described centrifugal blower 22 may be used. While not previously mentioned, the walls of the votive stand are made of non-flammable material such as galvanized sheet metal.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. In a votive stand, supporting surface means for a plurality of votive candles, said supporting surface means comprising plural stepped support surfaces for banks of votive candles, said stand having perforated portions disposed between said stepped surfaces, said perforated portions defining an inlet for the emissions of burning candles, and suction means including filtering means mounted in said stand contiguous to the stepped surfaces to draw the emissions of the burning candles into and through the suction means and filtering means for discharge in a clean state therefrom.

2. In a votive stand as defined in claim 1, and said perforated portions comprising inclined perforated panels located between said stepped support surfaces.

* * * * *